US006585874B2

(12) United States Patent
Moore

(10) Patent No.: US 6,585,874 B2
(45) Date of Patent: Jul. 1, 2003

(54) METHOD FOR USING ELECTROFORMING TO MANUFACTURE FRACTAL ANTENNAS

(75) Inventor: Jamie Moore, Corvallis, OR (US)

(73) Assignee: Hewlett-Packard Development Co. L.P., Houston, TX (US)

( * ) Notice: Subject to any disclaimer, the term of this patent is extended or adjusted under 35 U.S.C. 154(b) by 321 days.

(21) Appl. No.: 09/802,503

(22) Filed: Mar. 8, 2001

(65) Prior Publication Data

US 2002/0127417 A1 Sep. 12, 2002

(51) Int. Cl.[7] ..... C25D 1/00

(52) U.S. Cl. ..... 205/78; 205/67; 205/118; 205/122

(58) Field of Search ..... 205/67, 75, 76, 205/78, 118, 122; 29/600

(56) References Cited

U.S. PATENT DOCUMENTS 6,300,914 B1 * 10/2001 Yang ..... 343/741
6,476,766 B1 * 11/2002 Cohen ..... 343/700 MS
2002/0129488 A1 * 9/2002 Lieberman ..... 29/600
2002/0149521 A1 * 10/2002 Hendler et al. ..... 343/700 MS

OTHER PUBLICATIONS

Gearhart et al. "Integrated Antennas and Filters Fabricated Using Micromaching Techniques", Proc. of the 1998 IEEE Aerospace Conference (Mar. 21–28, 1998) vol. 3, pp. 249–254.*

Puente et al. "Multiband Properties of a Fractal Tree Antenna Generated by Electrochemical Deposition" Electronics Letters (Dec. 5, 1996) vol. 32, No. 25, pp. 2298–2299.*

Anagnostou et al. "Smart Reconfigurable Antennas for Satellite Applications" 2001 Core Technologies for Space Systems Conference (Nov. 28–30, 2001).*

* cited by examiner

*Primary Examiner*—Nam Nguyen
*Assistant Examiner*—Brian L. Mutschler

(57) ABSTRACT

One or more fractal antennas are produced in an electroforming circuit. A stainless steel on glass mandrel is covered with a dielectric in an inverse image of a fractal antenna to be formed. The portion of the stainless steel uncovered by the dielectric is chemically washed so that a fractal antenna formed thereon can be more efficiently removed. The mandrel is made a cathode in an electroforming circuit, which results in a fractal antenna being formed on the mandrel. The fractal antenna is separated from the mandrel and mounted on a rigid or semi-rigid substrate.

7 Claims, 4 Drawing Sheets

METHOD FOR USING ELECTROFORMING TO MANUFACTURE FRACTAL ANTENNAS

TECHNICAL FIELD

This invention relates to fractal antennas and, more particularly, to manufacturing fractal antennas using electroforming.

BACKGROUND

Antennas are used in a vast array of commercial applications that require radiation and/or reception of electromagnetic signals, such as cellular telephones, global positioning system (GPS) devices, and the like. Historically, Euclidean geometrical shapes—circles, squares, lines, triangles, etc.—have dominated antenna designs. A major drawback of such designs is that, as products incorporating antennas have become smaller and smaller, the effectiveness of antennas of these designs has decreased. This is because small sized antennas do not work well for several reasons due to the underlying electromagnetic principles.

In recent years, researchers have been applying fractal geometry—a non-Euclidean geometry—to antenna design. Fractal antennas have been developed and refined so that the traditional trade-off of lesser performance for smaller sized antennas has been minimized. Most of the benefit of fractal antennas has been seen in the performance of antenna arrays, single units that are actually arrays of up to thousands of small antennas. Use of fractal antennas in antenna arrays has allowed manufacturers to use only about a quarter of the number of elements in an array that were previously required.

However, it has been shown that even isolated antennas benefit from having a fractal shape. Bending a straight wire antenna into fractal shapes, for example, can pack the same antenna length into about a sixth of the area. At the same time, such a shape also generates electrical capacitance and inductance and provides a more sophisticated antenna.

Fractal antennas are twenty-five percent more efficient than the rubbery stub-like antennas found on most of today's cellular telephones. In addition, they are cheaper to manufacture, operate on multiple bands—thus allowing, for example, a GPS receiver to be build into the phone—and can be hidden away inside the body of the cell phone.

Currently, fractal antennas are manufactured using a traditional printed circuit board (PCB) process. Though there are several variations of PCB processes, generally, this process requires generating a film master of the antenna design, which is subsequently used to laminate dry-film etch resist to a copper/fiberglass substrate. The dry-film etch resist is exposed and then developed. The copper background is then etched with the antenna design. The etch resist is finally removed to provide the final product.

There are several problems that exist with utilizing such a method to produce fractal antennas. First, the etch resist must be photo patterned for every antenna produced. Second, the etching step requires hazardous material that must be disposed after the process is complete. Finally, copper foil on fiberglass substrate is relatively expensive.

SUMMARY

Systems and methods are described herein that utilize an electroforming technique to manufacture fractal antennas. Electroforming is a technique that is used to produce metal parts that have accurate contours and dimensions. An electrically conductive mandrel is made the cathode of an electro-forming circuit that includes an electrolyte solution in which the electrically conductive cathode is immersed. The electrolyte solution contains dissolved salts of the metal to be deposited and the anode of the circuit is a suspended slab of the metal to be deposited, i.e., the metal that will form the antenna. A current flow is applied to the circuit and this causes the metal from the anode to build up on the antenna pattern on the mandrel cathode. An appropriate amount of metal is plated onto the mandrel to form an antenna of a desired thickness. The mandrel and the antenna are then separated from each other and the antenna is bonded to a low cost substrate to form the final fractal antenna.

The electro-forming process exhibits several benefits over the traditional method of producing fractal antennas. The plating mandrel can be re-used up to five hundred times, thus eliminating the photo step for each manufacturing cycle. The amount of hazardous waste is decreased significantly; therefore, the cost of disposing of such waste is greatly reduced, as are the environmental consequences. The relatively low cost of the mounting substrate also provides a cost benefit over the previous technique.

BRIEF DESCRIPTION OF THE DRAWINGS

A more complete understanding of exemplary methods and arrangements of the invention may be had by reference to the following detailed description when taken in conjunction with the accompanying drawings wherein.

DETAILED DESCRIPTION

The following discussion is directed to an electroforming process for producing fractal antennas. A mandrel having the shape of the fractal antenna to be formed is used as the cathode in an electroforming circuit. Once produced, the mandrel can be re-used many times to produce similar fractal antennas.

Figure 1:
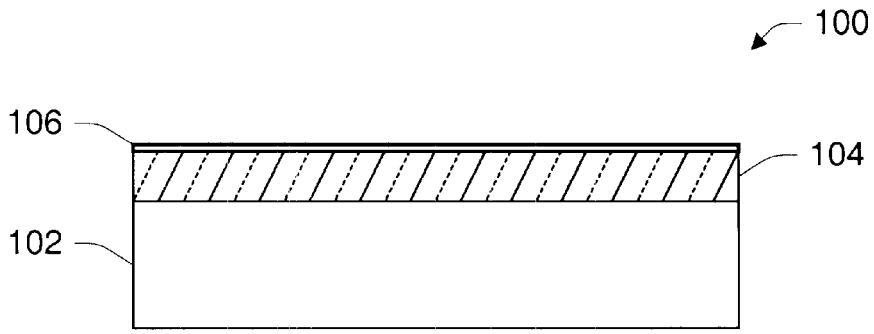
FIG. 1 is a side view of a mandrel as used in the implementations described herein.

FIG. 1 is an illustration of a reusable mandrel 100 for use in an electroforming process. The mandrel 100 has a glass substrate 102 on which an electrically-conductive layer 104 is deposited. The glass substrate may also be a polished silicon wafer, a plastic substrate, or any other suitable material known in the art. In a preferred embodiment, the electrically-conductive layer 104 is stainless steel, although any metal suitable for use in the processes described herein may be used. The electrically-conductive layer may vary in thickness according to techniques known in the art.

A dielectric 106 forms an electrically insulating layer on top of the electrically-conductive layer 104. The dielectric 106 is silicon carbide. However, it is noted that the dielectric 106 may be silicon nitride, silicon oxide or any other dielectric suitable for the purposes described herein.

Figure 2:
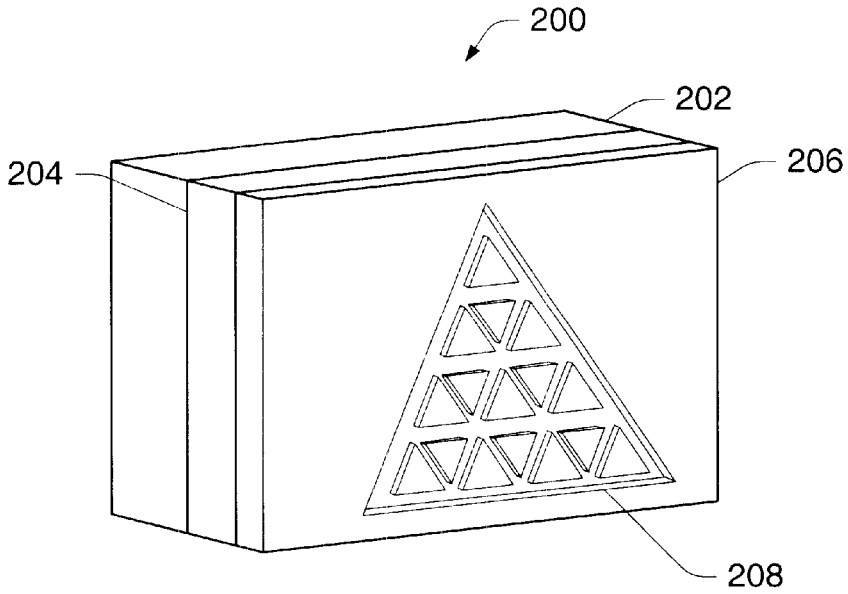
FIG. 2 is an illustration of mandrel having the shape of a fractal antenna formed therein.

FIG. 2 is an illustration of a mandrel 200 similar to the mandrel 100 shown in FIG. 1. The mandrel 200 includes a glass substrate 202, a stainless steel layer 204 and a silicon carbide dielectric 206 formed on the stainless steel layer 204. A mold 208 in the shape of a fractal antenna is formed in the dielectric.

The mandrel 200 may be formed by any method known in the art that is suitable for producing mandrels to be used in electroforming circuits. Generally, the process includes providing an electrically-conductive layer on a substrate, providing an electrically insulating layer on the electrically-conductive layer in such a way as to form a negative image mold of an object to be formed into the electrically insulating layer, and surface treating the mold pattern to reduce adhesion of a subsequently applied electroplated metal to the electrically-conductive layer.

The mandrel 200 is a glass substrate 202 having a stainless steel layer 204 thereon. The stainless steel layer 204 is deposited via a vacuum deposition process, such as an evaporation process, onto the glass substrate 202. Although the stainless steel layer 204 is shown as a single layer, the stainless steel layer 204 can include one or more other layers, such as a first layer of chromium (not shown) which bonds firmly to the glass substrate 202 and to the stainless steel layer 204. The dielectric 206 is patterned using a photoresist method or any other suitable method known in the art. In the photoresist method, the dielectric is deposited on the stainless steel layer 204 using a spinning process or a sputter process.

A photomask (not shown) in the shape of the fractal antenna to be formed is placed next to the dielectric 206 and the combination is exposed to ultra-violet light. The photomask is removed and the dielectric 206 is developed so that it obtains the pattern of the photomask, i.e., fractal antenna. Next, an etching process such as sputter-etching or chemical etching etches the unmasked dielectric 206 away, exposing the stainless steel layer 204 in the shape of the fractal antenna mold 208. Those skilled in the art can readily see how an inverse, or negative, image process can be used wherein an inverse of the image is photo-masked onto the dielectric 206. Any method that reliably forms the fractal antenna mold 208 may be used.

Figure 3:
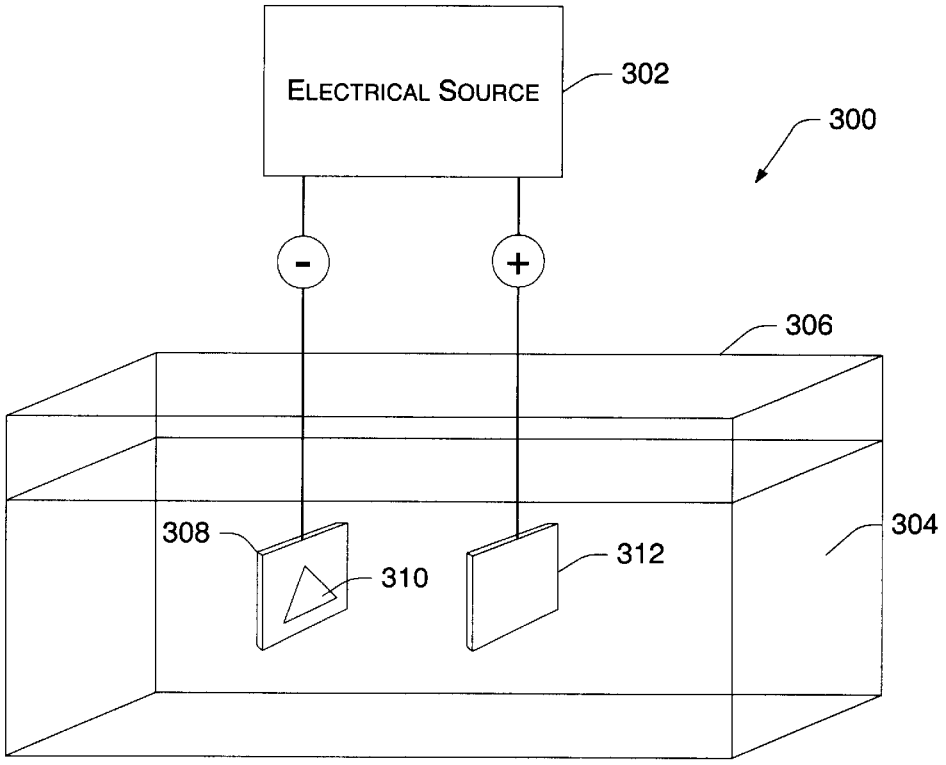
FIG. 3 is an illustration of an electro-forming circuit used to produce a fractal antenna.

FIG. 3 is an illustration of an electroforming circuit 300 for producing fractal antennas. The electroforming circuit 300 includes an electrical source 302 and an electrolyte solution 304 in a suitable container 306. A cathode-mandrel 308 is connected to the electrical source 302. The cathode-mandrel 308 is similar to the reusable mandrel 200 described in FIG. 2 and has a mold 310 formed therein in the shape of a fractal antenna to be formed. An anode 312 is suspended into the electrolyte solution 304 and is formed of a metal that will form the fractal antenna, such as nickel. The electrolyte solution 304 contains salts of the metal forming the anode 304.

When the electrical source 302 applies electricity to the electroforming circuit 300, metal is transferred from the anode 312 to the cathode-mandrel 308. Since the metal attaches only to the conductive areas of the cathode-mandrel 308, i.e., the stainless steel exposed by the mold 310, a fractal antenna in the shape of the mold 310 is formed. The electroforming process is continued until a fractal antenna of desired thickness is produced.

Figure 4:
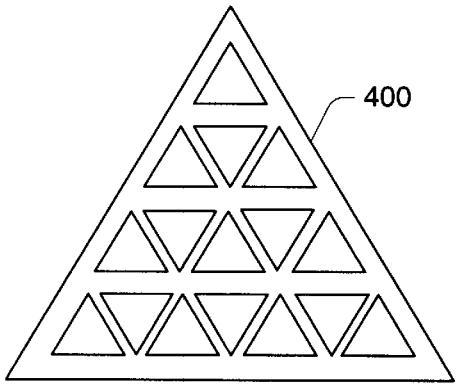
FIG. 4 is an illustration of a fractal antenna.

FIG. 4 shows a fractal antenna 400 after it has been separated from the cathode-mandrel 308 of FIG. 3. The surface treatment of the stainless steel layer allows the fractal antenna 400 to be separated from the cathode-mandrel efficiently. After the fractal antenna 400 is removed from the cathode-mandrel 308, the cathode-mandrel 308 may be chemically washed and/or treated to remove excess material deposited during the electroforming process and to treat the stainless steel layer so that a fractal antenna subsequently formed on the cathode-mandrel 308 may be more easily separated from the cathode-mandrel 308.

Figure 5:
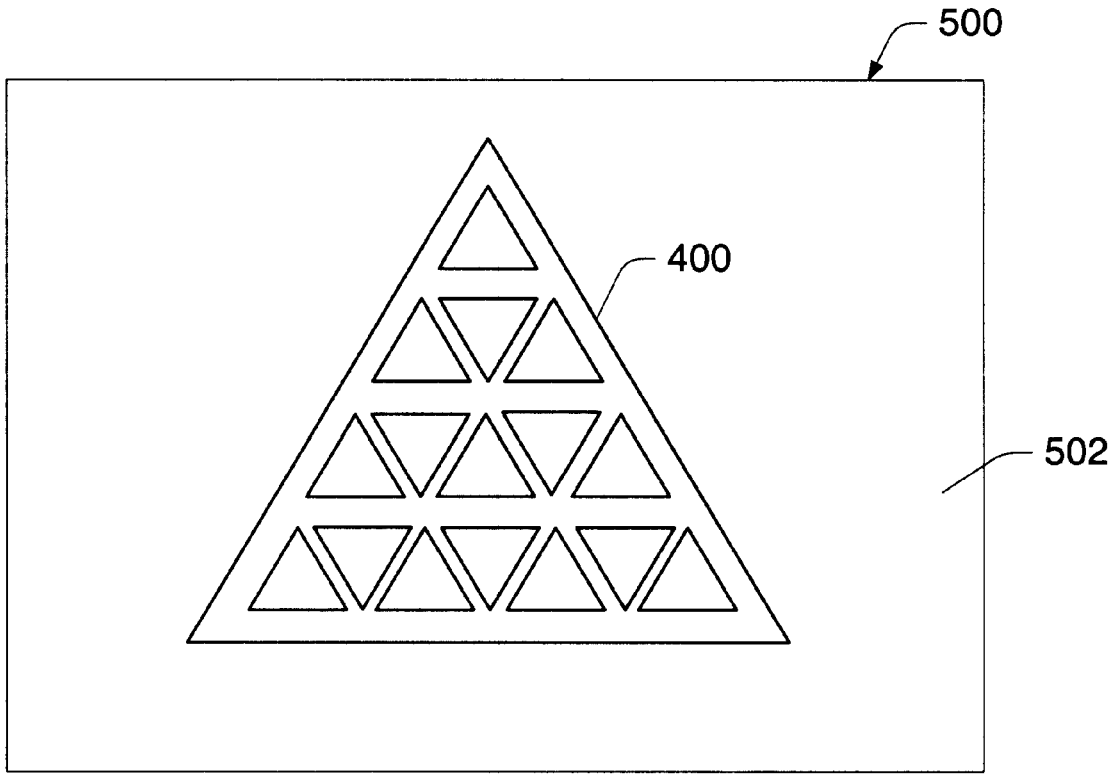
FIG. 5 depicts a fractal antenna mounted on a semi-rigid substrate.

FIG. 5 shows a fractal antenna 500 formed from bonding the fractal antenna 400 of FIG. 4 onto a rigid or semi-rigid substrate 502. The substrate 502 may be plastic or any other suitable material known in the art. The fractal antenna 500 may then be utilized in an electronic device (not shown).

The electroforming process may be repeated many times using the same cathode-mandrel 308. Therefore, the photo-etch process needs only to be performed once to produce several hundred fractal antennas, whereas the former methods required a photo-etch step to produce each fractal antenna. By using the processes described herein, the fractal antennas are produced more efficiently from an economic as well as an environmental standpoint.

Figure 6:
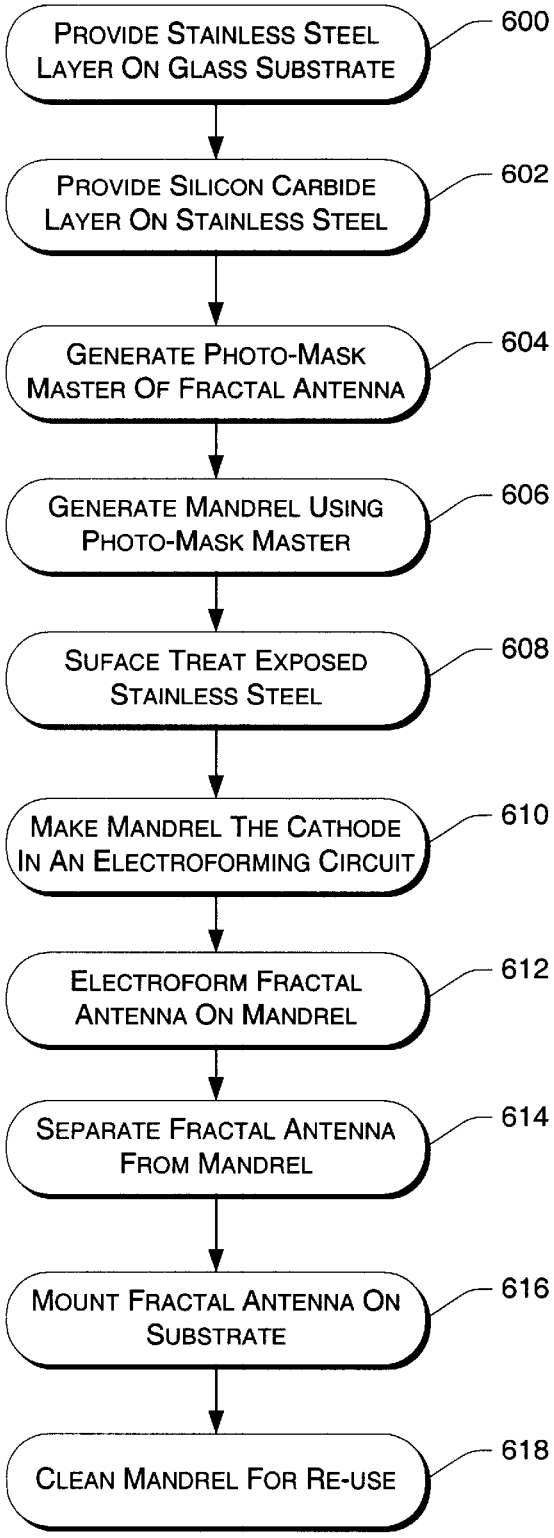
FIG. 6 is a flow diagram depicting a method for producing a fractal antenna using electroforming.

FIG. 6 is a flow diagram depicting a method for producing a fractal antenna using electroforming. Continuing reference will be made to the features and reference numerals of the previous figures (FIG. 1 through FIG. 5) when discussing FIG. 6.

At block 600, a stainless steel layer 204 is provided on a glass substrate 202 to begin formation of the mandrel 200. The stainless steel layer 204 may be bound directly to the glass substrate 202 or there may be an additional layer (not shown) between the glass substrate 202 and the stainless steel layer 204, such as a layer of chromium to which the glass substrate 202 and the stainless steel layer 204 bond exceptionally well.

A dielectric layer 206, preferable a silicon carbide layer, is provided on the stainless steel layer 204 at block 602. At block 604, a photo-mask master is generated having the image of the fractal antenna to be formed. Either a positive image process or a negative image process may be used at block 606 to form the image of the fractal antenna on the dielectric layer 206 of the mandrel 200. Typically, an image of the fractal antenna is placed adjacent to the mandrel 200 and is exposed to ultra-violet light. The result is developed to create an image of the fractal antenna on the dielectric layer 206. In one process, the portion of the dielectric layer 206 having the image of the fractal antenna on it is etched away. This leaves a mold 208 of the fractal antenna formed in the dielectric layer 206, the bottom of the mold 208 being the stainless steel layer 204.

At block 608, the exposed portion of the stainless steel layer 204 is surface treated so that a subsequently electroformed fractal antenna may be easily separated from the mold 208. The mandrel 200 is made the cathode 308 in an electroforming circuit 300 at block 610. Electricity is applied to the electroforming circuit at block 612 which causes metal from the anode 312 of the electroforming circuit 300 build up in the mold 310 in the mandrel 308, thus forming a fractal antenna 400. The process continues until the fractal antenna 400 is formed to the desired thickness.

At block 614, the fractal antenna 400 is separated from the mandrel 308 and is mounted on a rigid or semi-rigid substrate 502 at block 616 to form the final fractal antenna 500. At block 618, the mandrel 200, 308 is cleaned to remove excess material from the electroforming process and treat the mandrel 200, 308 to prepare the mandrel 200, 308 for use in forming another fractal antenna.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

I claim:

1. A method for producing a fractal antenna, comprising:

generating a photo-mask master of a fractal antenna;

using the photo-mask master to generate a mandrel;

electroforming a fractal antenna on the mandrel; and separating the fractal antenna from the mandrel.

2. The method as recited in claim 1, wherein the mandrel comprises a dielectric on a stainless steel layer, the dielectric containing a negative image of the fractal antenna where there is no dielectric material.

3. The method as recited in claim 2, wherein the dielectric is chosen from the following group: silicon carbide; silicon nitride; silicon oxide.

4. The method as recited in claim 1, further comprising mounting the fractal antenna to a semi-rigid substrate.

5. The method as recited in claim 1, further comprising mounting the fractal antenna to a rigid substrate.

6. The method as recited in claim 1, wherein the electroforming a fractal antenna further comprises making the mandrel a cathode in an electroforming circuit having an electrolyte solution and an anode, the anode being formed from a metal to be deposited on the cathode-mandrel to form the fractal antenna, and the electrolyte solution containing a dissolved salt of the metal.

7. The method as recited in claim 1, further comprising:

chemically cleaning the mandrel; and re-using the mandrel to electroform a fractal antenna.

* * * * *